US007554534B2

(12) United States Patent
Takaki et al.

(10) Patent No.: US 7,554,534 B2
(45) Date of Patent: Jun. 30, 2009

(54) NOISE ELIMINATION CIRCUIT OF MATRIX DISPLAY DEVICE AND MATRIX DISPLAY DEVICE USING THE SAME

(75) Inventors: Jiro Takaki, Kumamoto (JP); Kazuhiro Ishiguchi, Kumamoto (JP); Akihiro Minami, Kumamoto (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 687 days.

(21) Appl. No.: 11/340,632

(22) Filed: Jan. 27, 2006

(65) Prior Publication Data

US 2007/0018932 A1 Jan. 25, 2007

(30) Foreign Application Priority Data

Jul. 25, 2005 (JP) ..... 2005-214580

(51) Int. Cl.
*G09G 5/00* (2006.01)

(52) U.S. Cl. ..... 345/204

(58) Field of Classification Search ..... 345/87, 345/98, 99, 104, 204
See application file for complete search history.

(56) References Cited

U.S. PATENT DOCUMENTS 5,664,045 A * 9/1997 Park ..... 386/114
5,835,542 A * 11/1998 Lu ..... 375/359
7,259,755 B1 * 8/2007 Ahn ..... 345/204

FOREIGN PATENT DOCUMENTS

| | | |
|---|---|---|
| JP | 11-214964 | 8/1999 |
| JP | 11-251884 | 9/1999 |
| JP | 11-282401 | 10/1999 |
| JP | 2000-209076 | 7/2000 |
| JP | 2000-341098 | 12/2000 |
| JP | 2002-271427 | 9/2002 |

* cited by examiner

*Primary Examiner*—Sumati Lefkowitz
*Assistant Examiner*—Rodney Amadiz
(74) *Attorney, Agent, or Firm*—Oblon, Spivak, McClelland, Maier & Neustadt, P.C.

(57) ABSTRACT

A noise elimination circuit that eliminates a noise of a display control signal of a matrix display device, includes a rising edge detection circuit unit that detects a rising edge of a signal for eliminating a noise, a counter that performs a count operation during a predefined period of time, an initialization circuit unit that generates an initialization signal of the counter, a count enable circuit unit that generates a count allowance signal of the counter, and an initial state detection circuit unit that detects whether or not the counter is in an initial state. The counter starts the count operation from an initial value in response to a rising edge detection by the rising edge detection circuit unit. The counter is initialized again after the count operation during the predefined period of time is completed. An initial state detection signal by the initial state detection circuit unit becomes a signal from which a noise is eliminated.

10 Claims, 10 Drawing Sheets

6

NOISE ELIMINATION CIRCUIT OF MATRIX DISPLAY DEVICE AND MATRIX DISPLAY DEVICE USING THE SAME

BACKGROUND OF THE INVENTION

1. Field of the Invention

The present invention relates to a noise elimination circuit of a matrix display device and a matrix display device using the noise elimination circuit, and in particular, to a noise elimination circuit included in a timing controller of a liquid crystal display device.

2. Description of the Related Art

In the related art, when a high voltage is applied to a casing body of a matrix display device, such as a liquid crystal display device, in a static noise test, for example, an abnormal display of the moment has been viewed. The abnormal display mainly occurs because a noise is introduced into an input terminal of the liquid crystal display device and the noise is superposed on a signal within a digital circuit included in a timing controller of the liquid crystal display device, and as a result, the timing controller malfunctions to output various control signals at timings different from those in a normal state.

Output signals of the timing controller mounted in the liquid crystal display device include a horizontal direction start pulse, a vertical direction start pulse, and the like, which are affected by the superposition of the static noise introduced into the input terminal. When the timing of the horizontal direction start pulse deviates, a line noise is generated, and when the horizontal direction start pulse is not output, the abnormal display, such as omission of a line, occurs. In addition, when the timing of the vertical direction start pulse deviates, the display rocking in the vertical direction occurs, and when the vertical direction start pulse is not output, the abnormal display, such as omission of a frame, occurs. The omission of a frame is not a big problem in a still image, while the omission of a frame causes a screen jump so as to make unnatural movements in a moving picture.

Further, in the case of an interface where horizontal and vertical synchronization signals are not included in a display control signal between the liquid crystal display device and a display controller controlling the liquid crystal display device, when a noise is superposed on a data enable signal (hereinafter, referred to as 'DENA') indicating the effective timing of display data, deformation of an image is noticeable, which has been a serious problem.

Furthermore, in an LVDS (low voltage differential signaling) interface widely used as an interface standard of the display control signal, when an operation voltage becomes less than a predetermined level, a receiving operation of an LVDS receiver becomes unstable, which causes malfunction so as to generate a noise signal.

A noise elimination circuit for preventing a digital circuit from malfunctioning when a noise is introduced thereinto has been proposed in which noise components of input signals are eliminated by preparing a plurality of input stages in consideration of a case where noises are included in the input signals and then comparing the input signals so as to determine the reliability of the signals (refer to JP-A-11-282401).

Further, there has been known a method in which a delay circuit is provided to a signal input stage and an input signal and a delayed input signal are combined so as to eliminate a noise (refer to JP-A-11-214964 and JP-A-11-251884).

Furthermore, there has been known a method in which a first filter circuit for a high frequency noise (narrow pulse width) and a second filter circuit for a low frequency noise (wide pulse width) are connected to each other so as to form a noise filter circuit (refer to JP-A-2000-341098).

In addition, a noise detection circuit for detecting noises, such as continuously generated noises or a noise having a wide pulse width (refer to JP-A-2000-209076).

In the noise elimination circuit disclosed in JP-A-11-282401, the sufficient performance cannot be obtained because, for example, noises cannot be filtered when the noises are introduced into all stages. In addition, in the noise elimination circuits disclosed in JP-A-11-214964 and JP-A-11-251884, in the case of a noise having a predefined pulse width or continuously generated noises, a noise of the input signal and a noise of the delayed input signal are superposed, and accordingly, the noise cannot be completely eliminated. In addition, in the noise elimination circuit disclosed in JP-A-2000-341098, since there is a limitation on the pulse width of a noise which can be eliminated, there is a possibility that an original signal will be removed when a noise having a wide pulse width is eliminated.

Further, in the noise detection circuit disclosed in JP-A-2000-209076, a level monitoring circuit for generating a level monitor signal for a predetermined period of time by detecting rising (or falling) edges of the input signal is provided so as to detect a noise during an operation period of the level monitoring circuit. However, in the noise detection circuit, even though a noise (Low) signal during an active (High) period can be detected, a noise (High) signal during an inactive (Low) period cannot be detected, and also, an additional noise elimination circuit is needed to obtain an original input signal because a noise elimination circuit is not provided.

Furthermore, in the noise elimination circuit disclosed in JP-A-2000-271427, an edge of the input signal is detected by using an edge detector, a timer that counts a predetermined period of time subsequent to the edge and a mask unit that masks the input signal while the timer counts are provided, and the input signal is masked, thereby eliminating noises. However, in the noise elimination circuit, even though a noise (Low) signal during an active (High) period can be detected, a noise (High) signal during an inactive (Low) period cannot be detected.

In addition, the active (High) period refers to a case in which the signal is a signal determining whether other input signals (for example, a data signal) are effective or not and the input signal is effective. The inactive (Low) period refers to a case in which the input signal is not effective. Hereinafter, definitions of the active and inactive periods are the same as described above.

SUMMARY OF THE INVENTION

According to an aspect of the invention, a noise elimination circuit, for eliminating a noise of a display control signal, of a matrix display device, includes: a rising edge detection circuit unit that detects a rising edge of a signal for eliminating a noise; a counter that performs a count operation during a predefined period of time; an initialization circuit unit that generates an initialization signal of the counter; a count enable circuit unit that generates a count allowance signal of the counter; and an initial state detection circuit unit that detects whether or not the counter is in an initial state. The counter starts a count operation from an initial value in response to a rising edge detection of the rising edge detection circuit unit and the counter is initialized again after the count operation during the predefined period of time is completed, and thus an initial state detection signal of the initial state detection circuit unit 24 becomes a signal from which a noise is eliminated.

In a flat panel display device, such as a liquid crystal display device, a control signal input to a liquid crystal driving circuit can be maintained in a normal operation state so as to prevent abnormal display from occurring by using the noise elimination circuit in a timing controller mounted in the flat panel display device.

DETAILED DESCRIPTION OF THE INVENTION

First Embodiment

Figure 1:
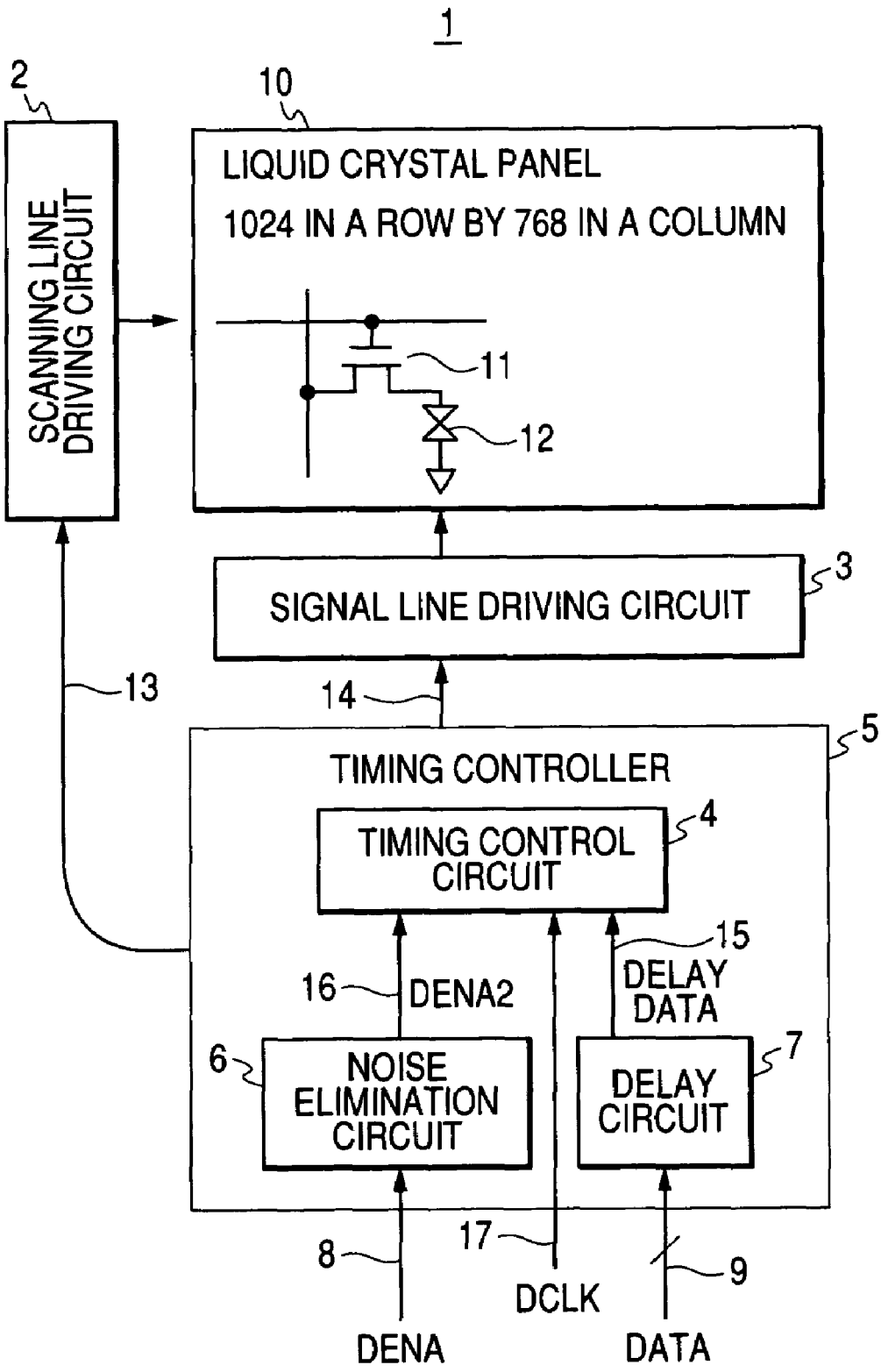
FIG. 1 is a view illustrating the system configuration of a liquid crystal display device according to anyone of first to fourth embodiments of the invention.

FIG. 1 is a view illustrating the system configuration of a liquid crystal display device 1 including a timing controller 5 having a noise elimination circuit 6 according to a first embodiment. Referring to FIG. 1, a liquid crystal panel 10 has an XGA (Extra Graphic Array) resolution, pixels 12 and TFTs 11 for driving the pixels 12, the pixel 12 and the TFT 11 being shown as a representative, are disposed in a matrix of 768 in a row by 1024×3 (corresponding to R, G, and B) which are not shown, a scanning line driving circuit 2 connected to a plurality of scanning lines and a signal line driving circuit 3 connected to a plurality of signal lines are disposed around a matrix display unit of the liquid crystal panel 10.

Figure 2:
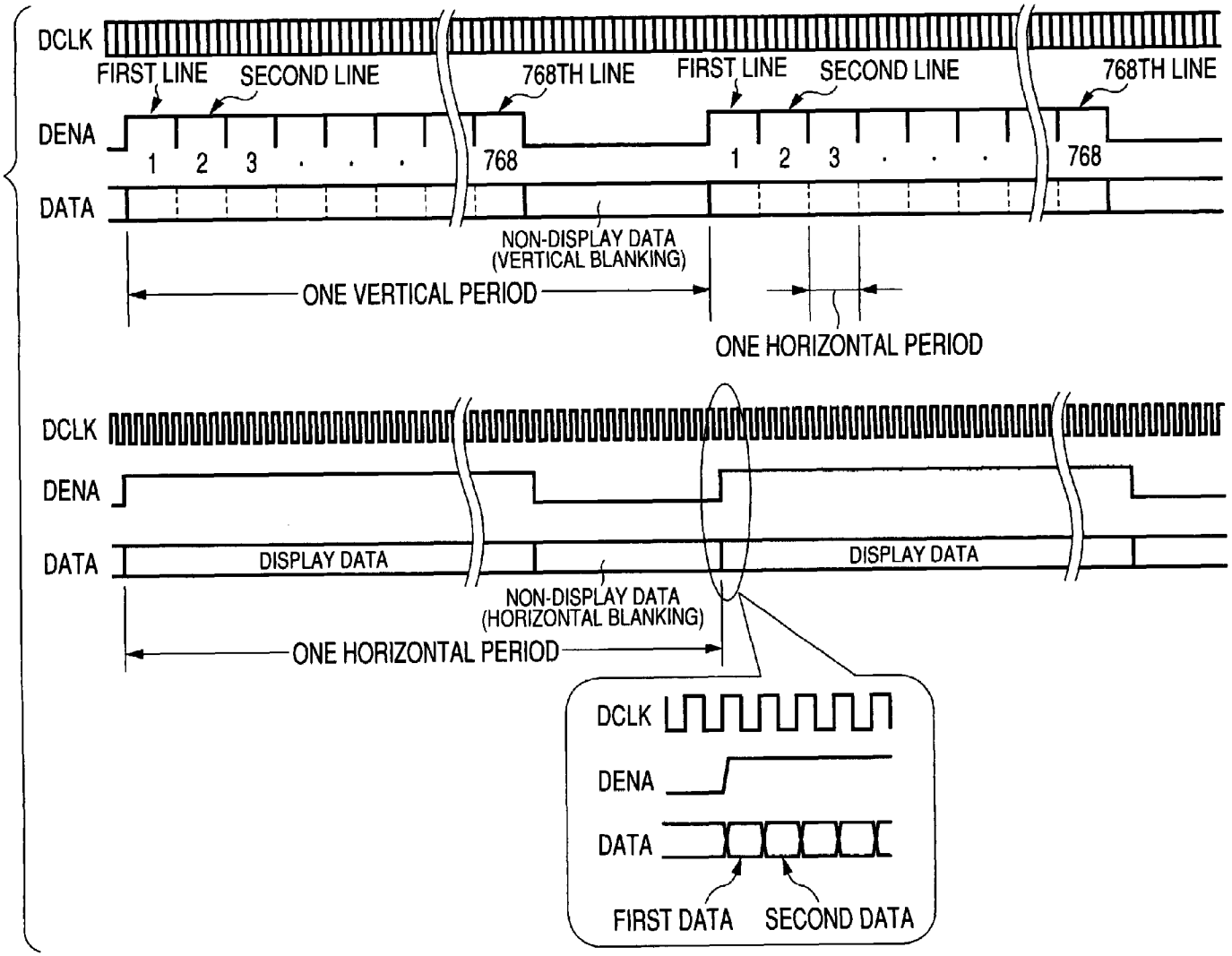
FIG. 2 is a view illustrating display control signals and timings thereof, which are input to the liquid crystal display device according to any one of the first and third embodiments.

In the first embodiment, a display control signal, which is inputted to the timing controller 5 of the liquid crystal display device 1 from a display controller, and the timing thereof adopts a typical timing having a high compatibility as shown in FIG. 2 and will be described below in detail.

In FIG. 2, a data enable (hereinafter, referred to as 'DENA') signal and a display data (hereinafter, referred to as 'DATA') signal are read out at a timing synchronized with a falling (or rising) edge of a dot clock (hereinafter, referred to as 'DCLK') in a digital circuit of the timing controller 5, and the DATA signal displayed on the liquid crystal panel 10 is determined to be effective for the digital circuit during an active period (High period) of the DENA signal. Further, the upper half of FIG. 2 shows the timing relationship between the DCLK and the DENA and DATA signals for two frames. For a first frame, a period while the DENA signal is in an active state during a relatively long period (typically, tens of horizontal periods), that is, 1024 DCLK period during which a vertical blanking is completed and the DENA signal becomes active (High) for the first time, indicates a DATA signal effective period of a first line, and 1024 DCLK period during which next DENA signal becomes active with a horizontal blanking period (typically, tens of DCLK periods), which will be described later, interposed therebetween indicates a DATA effective period of a second line. In addition, a final DENA signal activation period (1024 DCLK period) immediately before a vertical blanking period between next frame and the final DENA signal activation period is a DATA signal effective period of a final 768th line.

Next, the timing between DCLK and DENA and DATA signals for two horizontal periods will be described by referring to the lower half of FIG. 2. As described above, display data displayed on the liquid crystal panel 10 is read out in synchronization with falling edge of DCLK, first display data, that is, a DATA signal inputted to a left-end pixel of each horizontal line on a display screen is displayed during a first DCLK period where the DENA signal rises from an inactive state to an active state, and second display data is displayed during next DCLK period. Then, the DATA signals until 1024 DCLK are sequentially read out to the digital circuit of the timing controller 5. When the DENA signal rises and thus 1025 DCLK period elapses, the DENA signal becomes inactive (Low), resulting in a horizontal blanking period. Then, by repeating the above-described operation 768 times, data corresponding to one frame, that is, one screen is input to the timing controller 5.

Further, the relationships between the timing controller 5 and the scanning line driving circuit 2 and the signal line driving circuit 3 will be described. A timing control circuit 4 of the timing controller 5 shown in FIG. 1 generates a scanning line driving control signal 13, such as a horizontal direction start pulse and a vertical direction start pulse, from the inputted DCLK and the DENA and DATA signals, and then outputs the scanning line driving control signal 13 to the scanning line driving circuit 2. In addition, the scanning line driving control signal 13 generates a signal line driving control signal 14, such as a horizontal direction start pulse, a latch pulse, or display data, and then outputs the signal line driving control signal 14 to the signal line driving circuit 3.

The control signals 13 and 14 are generated by using the timing control circuit 4 of the timing controller 5 at a predetermined timing on the basis of the timing type of an input signal of a gate driver IC used in the scanning line driving circuit 2 or a source driver IC used in the signal line driving circuit 3.

Next, the noise elimination circuit 6 and a delay circuit 7 shown in FIG. 1 will be described. As shown in FIG. 1, the timing controller 5 includes the timing control circuit 4, the noise elimination circuit 6, and the delay circuit 7. The noise elimination circuit 6 is input with a DENA signal 8 supplied from the display controller and outputs a DENA2 signal 16 after noise elimination. The delay circuit 7 is input with a DATA signal 9 and outputs a delay DATA signal 15 delayed for a predetermined DCLK period.

As described above, the timing control circuit 4 of the timing controller 5 is input with the DCLK or the DENA2 signal 16 after noise elimination and the delay DATA signal 15, and the control signals 13 and 14 are generated on the basis of these signals to be output to the scanning line driving circuit 2 and the signal line driving circuit 3. It is determined whether the delay DATA signal 15 inputted in synchronization with DCLK is effective or not by the DENA2 signal 16 synchronized with the DCLK.

Further, as described above, a vertical direction CLK and a vertical direction start pulse, which are scanning line driving control signals 13, are output from the timing controller 5 to the scanning line driving circuit 2, and an output DATA, a horizontal direction start pulse, and a latch pulse, which are signal line control signals 14, are output from the timing controller 5 to the signal line driving circuit 3.

Next, operation timings of the noise elimination circuit 6 and the delay circuit 7 will be described with reference to FIG. 3.

Figure 3:
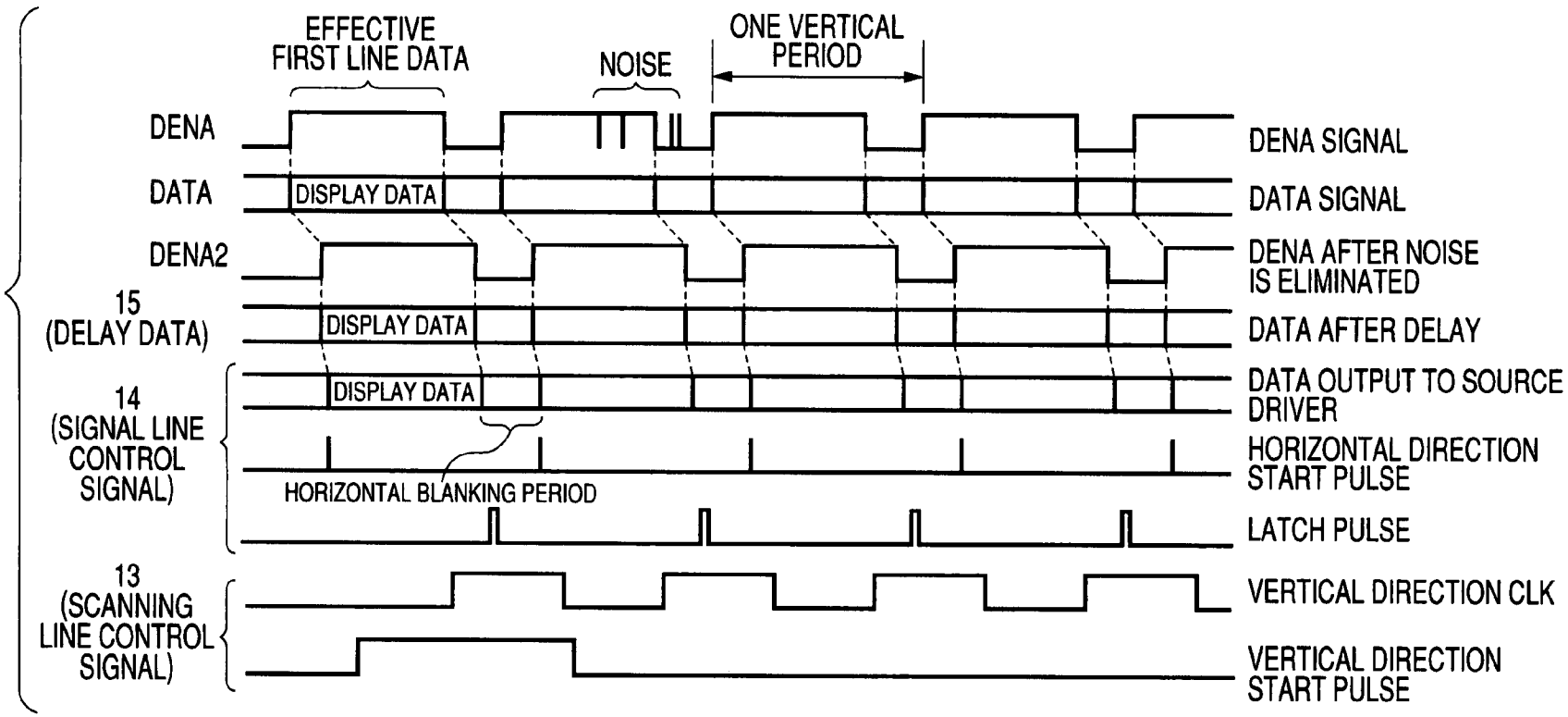
FIG. 3 is a timing diagram of a timing controller according to any one of the first and third embodiments.

Referring to FIG. 3, the timing of a main display control signal of the timing controller 5 including the noise elimination circuit 6 is illustrated. In FIG. 3, the horizontal direction start pulse included in the signal line control signal 14 is output at a timing before 1 DCLK period of first data after output DATA, which is output to a source driver IC, included in the signal 14 is horizontally blanked, and the vertical direction start pulse included in the scanning line control signal 13 is output at a first horizontal scanning timing after the vertical blanking.

As described above, since the DENA signal is used to determine whether or not display data is effective, the timing of the DENA signal is important in order to obtain the accurate positions of the first DATA signal timing after the horizontal blanking and the horizontal scanning timing after the vertical blanking, and accordingly, the noise elimination circuit 6 is required for wiring lines of the DENA signal.

In the noise elimination circuit 6, since the DENA signal is delayed for a predetermined period of time as will be described later, it is necessary to delay the DATA signal for the same period of time as above. That is, by synchronizing the timing of the DENA signal with the timing of the DATA signal, it is possible to form the timing controller 5 without changing the subsequent timing control circuit 4.

Further, when an additional circuit, such as a data conversion circuit, which is mounted in the timing controller 5 and delays the DATA signal, is needed, it is possible not to prepare a useless delay circuit by setting the delay time of the noise elimination circuit 6 in consideration of the delay time due to the additional circuit.

Figure 4:
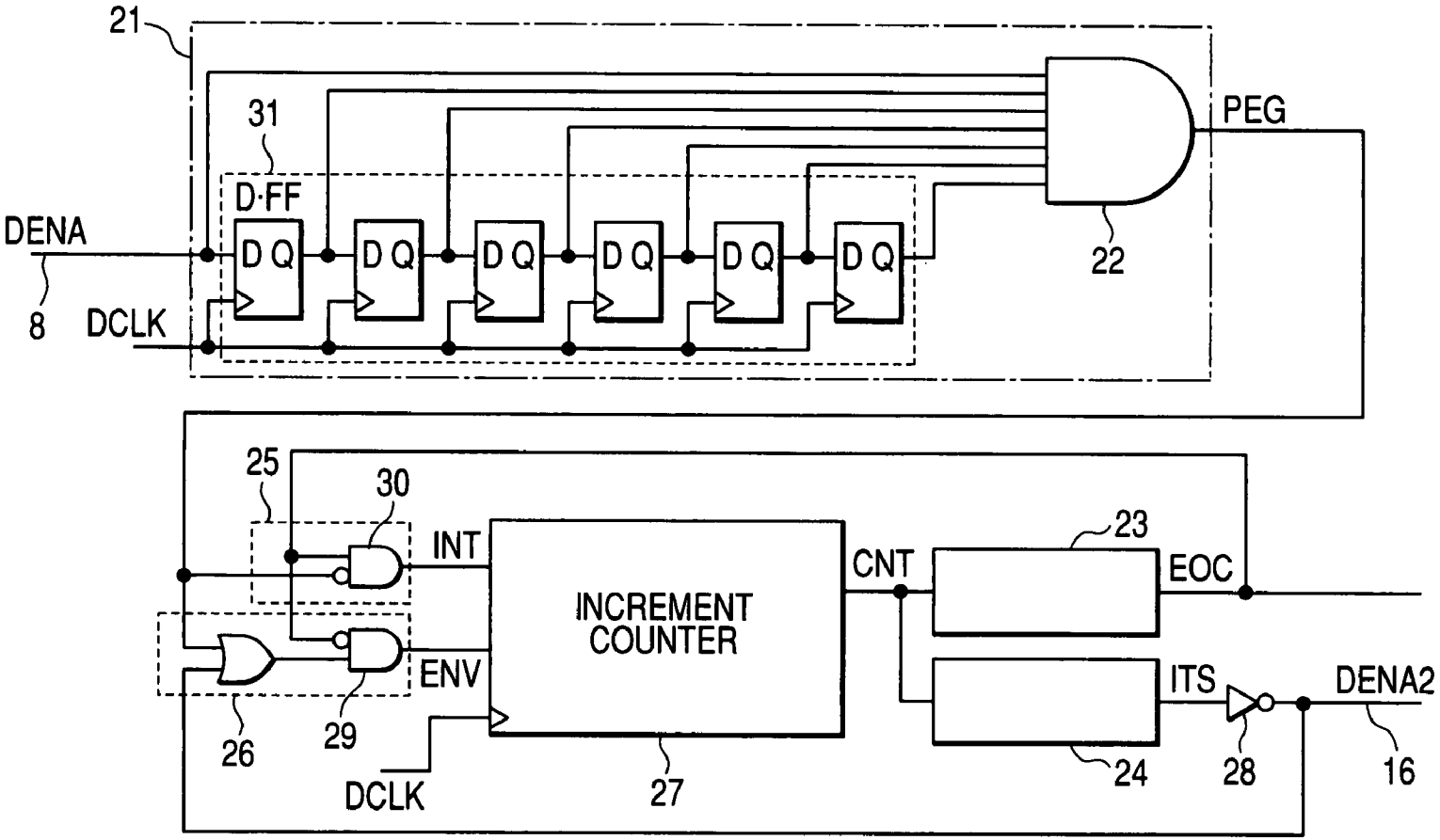
FIG. 4 is a view illustrating the configuration of a noise elimination circuit according to the first embodiment of the invention.

Next, FIG. 4 illustrates the construction of the noise elimination circuit 6 according to the first embodiment. The noise elimination circuit 6 includes: a delay circuit block 31 composed of D flip-flop circuits (hereinafter, referred to as 'D-FF') operating in synchronization with the same DCLK signal; a DENA rising edge detection unit 21 composed of a seven-input AND circuit unit 22 to which the input signal DENA and signals sequentially delayed to be input to the D-FF circuits for 1 DCLK; a counter 27 to which the DCLK is input so as to count the number of input pulses of the DCLK; a count enable circuit unit 26 to which a rising edge detection output signal PEG of the AND circuit unit 22 is input and which outputs a count allowance signal ENV to the counter 27, the count allowance signal ENV controlling an operation or a stop of a counter function of the counter 27; an initialization circuit unit 25 to which the rising edge detection output signal PEG of the rising edge detection unit 21 is input and which generates an initialization signal INT of the counter 27 to be output to the counter 27; a horizontal pixel number detection unit 23 that detects whether or not a count output CNT of the counter 27 matches a specified value 1024, which is predefined, on the basis of the resolution of a display panel 10 and then outputs a count stop signal EOC to the initialization circuit unit 25 and the count enable circuit unit 26 when the count output CNT of the counter 27 matches the specified value 1024; an initial state detection unit 24 to which the output CNT of the counter 27 is input so as to detect whether the counter 27 is in an initial state and outputs a counter initial state signal ITS; and an inverting buffer 28 to which the counter initial state signal ITS is input so as to generate the data enable output signal DENA2. An output signal DENA2 of the inverting buffer 28 becomes a signal 16 after the noise elimination. Here, the counter 27 adopts an up-count method. Therefore, since the output CNT becomes zero when the counter 27 is initialized, the initial state detection unit 24 includes a zero value detection circuit detecting whether the output CNT is zero. On the other hand, the horizontal pixel number detection unit 23 includes a specified value detection circuit determining whether the output CNT of the counter 27 has reached the specified value.

In addition, the DENA2 is input to the count enable circuit unit 26. Here, the specified value set in the horizontal pixel number detection unit 23 is 1024 because the resolution of the liquid crystal panel 10 is XGA.

Next, an operation of the noise elimination circuit 6 shown in FIG. 4 will be described in detail with reference to a timing diagram of FIG. 5. In the first embodiment shown in FIGS. 4 and 5, the delay circuit block 31 and the AND circuit unit 22 to which six delayed output signals of the delay circuit block 31 and the DENA signal 8 are input detect whether the DENA signal 8 maintains an active (High) state during consecutive seven DCLK periods, and output the rising edge detection output PEG as High when the DENA signal 8 is continuously in the active state. That is, the signal PEG detects a rising edge of the DENA signal 8, and the delay time until the rising edge is detected corresponds to six DCLK periods. The delay time is dependent on the number of D-FFs of the delay circuit block 31, and a case in which six D-FFs are provided is exemplified in the first embodiment.

Figure 5:
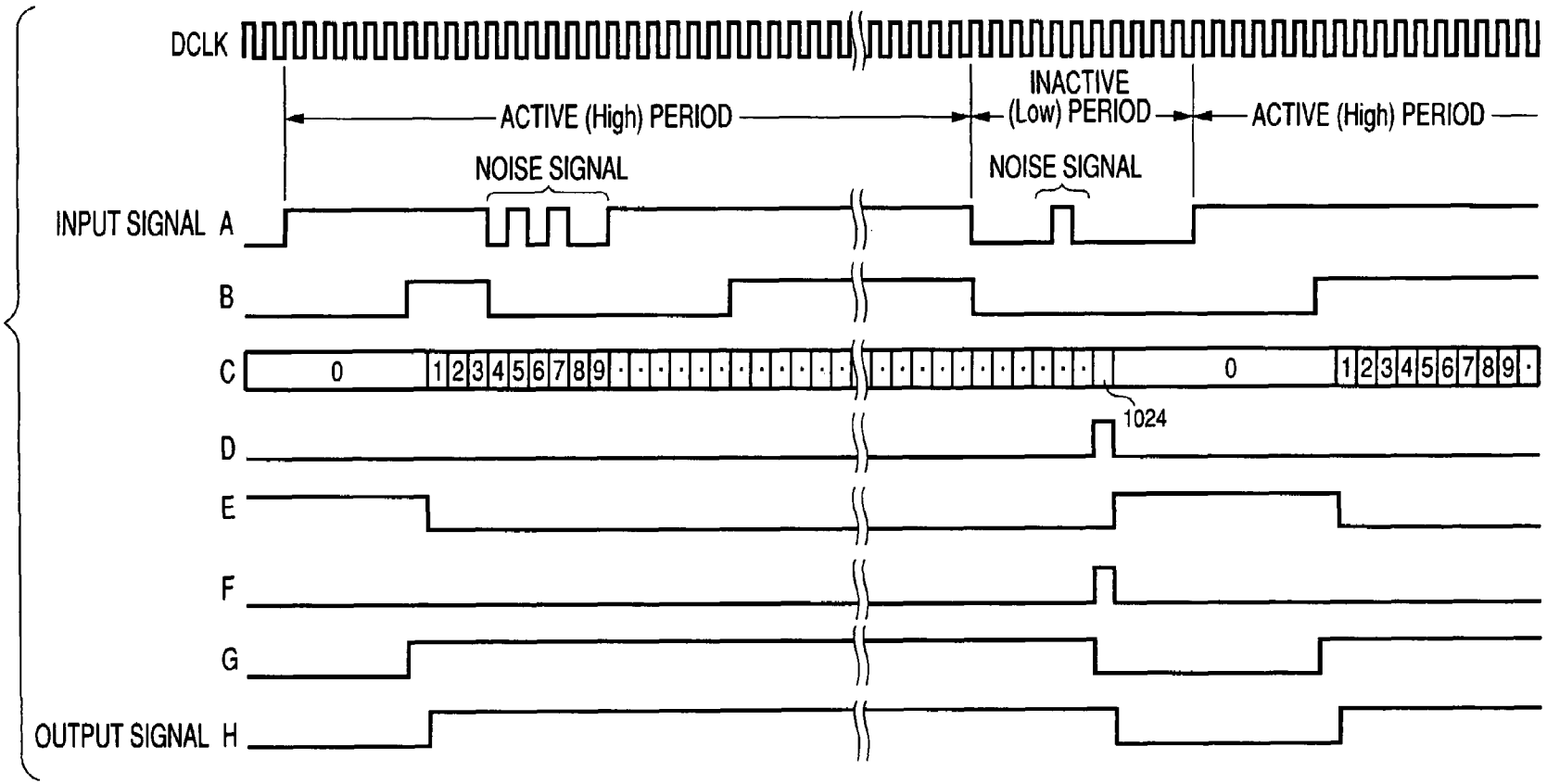
FIG. 5 is a timing diagram of the noise elimination circuit according to the first embodiment of the invention.

Here, when the rising edge of the DENA signal is input and the rising edge detection output signal PEG shown in FIG. 5 becomes High, the count allowance signal ENV becomes High and then the counter 27 starts a count-up operation of the DCLK. When the count value CNT of the counter 27 reaches the specified value 1024, a count stop signal EOC (High pulse) is output from the horizontal pixel number detection unit 23 to be input to the initialization circuit unit 25. At this time, the counter 27 counts a specified period of time, that is, a period from 0 to the specified value 1024 DCLK, which is set in the horizontal pixel number detection unit 23.

Here, the input DENA signal 8 is inactive (Low) because 1024 DCLK periods has already elapsed, and the signal PEG having passed through the AND circuit unit 22 becomes Low. As a result, an output signal of an AND circuit 30 of the initialization circuit unit 25, that is, the initialization signal INT becomes High, and the counter 27 is initialized after next 1 DCLK is input thereto, and accordingly, the count output CNT becomes an initialization value 0. When the count output 0 is input to the initial state detection unit 24, the initial state detection unit 24 detects the initial state and the output signal ITS becomes High. The data enable output DENA2 signal 16, which is an inversion signal of the signal ITS, becomes High except that the counter value CNT is zero.

Further, an operation when a noise having a predetermined pulse width is superposed on the DENA signal 8 will be described with reference to FIG. 5. In the case in which the LVDS receiver malfunctions, if a noise is considered to have a pulse width in the range of only several to tens of several DCLK periods, it is not sufficient to determine whether or not the noise is included in the range. Therefore, a case in which a noise having a pulse width larger than that in the range is generated should be considered.

In the first embodiment, even though a Low component noise signal, which has a pulse width longer than the delay time corresponding to the number of D-FFs of the delay circuit block 31, generated while the DENA signal 8 is in an active (High) state, if the counter 27 is in a count-up operation, the noise can be eliminated without affecting the count operation of the counter 27.

Figure 6:
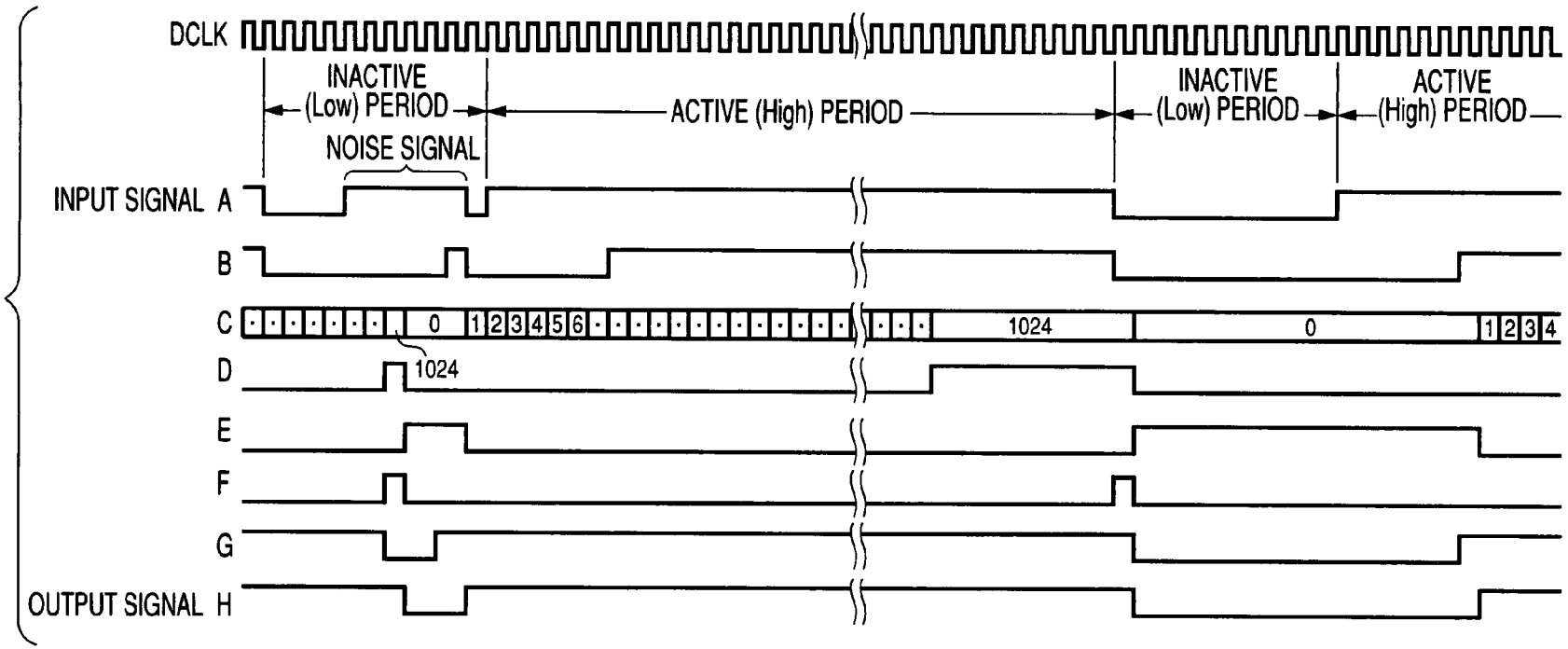
FIG. 6 is a timing diagram of the noise elimination circuit according to the first embodiment of the invention.

Next, by referring to FIG. 6, it will be described about an operation of the noise elimination circuit 6 when a noise is generated during an inactive (Low) period of the DENA signal 8 and a noise (High) signal, which has a pulse width longer than the total delay time (DCLK period×the total number of D-FFs) of the delay circuit block 31, is superposed on the DENA signal.

Due to the wide-pulse noise generated during the inactive (Low) period, the delay circuit block 31 and the seven-input AND circuit unit 22 erroneously detect the noise (High) signal as an input signal, and as a result, the counter 27 starts a count-up operation. The counter 27 performs the count-up operation up to the specified value 1024. Thereby, an AND circuit 29 of the count enable circuit unit 26 generating the count allowance signal ENV operates to have the count allowance signal ENV become Low and to keep maintaining the counter value CNT until the DENA signal 8 becomes inactive (Low). In addition, the initialization circuit unit 25 generating the initialization signal INT does not cause the counter 27 to be initialized because the rising edge detection output PEG is High.

Subsequently, a normal horizontal blanking period corresponding to next horizontal scanning period starts, and accordingly, the DENA signal becomes inactive (Low), the rising edge detection output becomes Low, and the initialization output INT operates to initialize the counter 27. Due to the operations described above, it is possible to suppress the malfunction to the minimum (corresponding to one line).

In other words, an AND circuit 29 of the count enable circuit unit 26 is input with an inversion signal of the count stop signal EOC output from the horizontal pixel number detection unit 23 and OR output between the rising edge detection output signal PEG of the DENA rising edge detection unit 21 and the output DENA2 signal of the inverting circuit 28, and then an AND operation with respect to the inversion signal and the OR output is performed, thereby generating the count allowance signal ENV. Accordingly, as shown in FIG. 6, even though a long pulse noise is superposed on the input DENA signal during an inactive period thereof and the data enable output DENA2 signal 16 malfunctions by one line such that a count value of the counter 27 reaches 1024 through a number of DCLKs smaller than in a typical case and thus the output EOC of the horizontal pixel number detection unit 23 becomes High, the count value 1024 of the counter 27 is maintained until a normal inactive signal Low is input as the DENA signal 8 corresponding to next horizontal scanning line, and the initialization of the counter 27 is performed by next DCLK subsequent to the normal inactive signal Low. As a result, the abnormal display due to the deviation of the DENA signal 8 is limited to only one horizontal line.

Further, when the counter value CNT of the counter 27 reaches 1024 and the output count stop signal EOC of the horizontal pixel number detection unit 23 becomes High, an output of the AND circuit 29 becomes Low and the counting operation of the counter 27 stops, and thus the count value 1024 at this time is maintained. When malfunction occurs due to noises, the counter 27 can be initialized at an inactive timing of next normal DENA signal 8 by holding the specified value 1024, and thus it is possible to prevent continuous malfunctions from occurring.

Here, in the operation of the noise elimination circuit 6, the specified value exemplified in the first embodiment is not necessarily 1024, but the value may be set according to the design condition in consideration of the resolution of a liquid crystal panel. For example, the specified value of the horizontal pixel number detection unit 23 is determined by the specifications of an expected value of the pulse width of an input DENA signal, which is specified in the resolution specifications of a liquid crystal panel. That is, the specified value corresponds to the pulse width of the DENA signal of an input signal in a liquid crystal display device. For example, if the resolution is XGA, the specified value is 1024, if the resolution is SVGA (Super VGA), the specified value is 800, and if the resolution is VGA, the specified value is 640. In addition, in the case in which data signals are divided, for example, the specified value may be 512 for XGA and 400 for SVGA.

Figure 7:
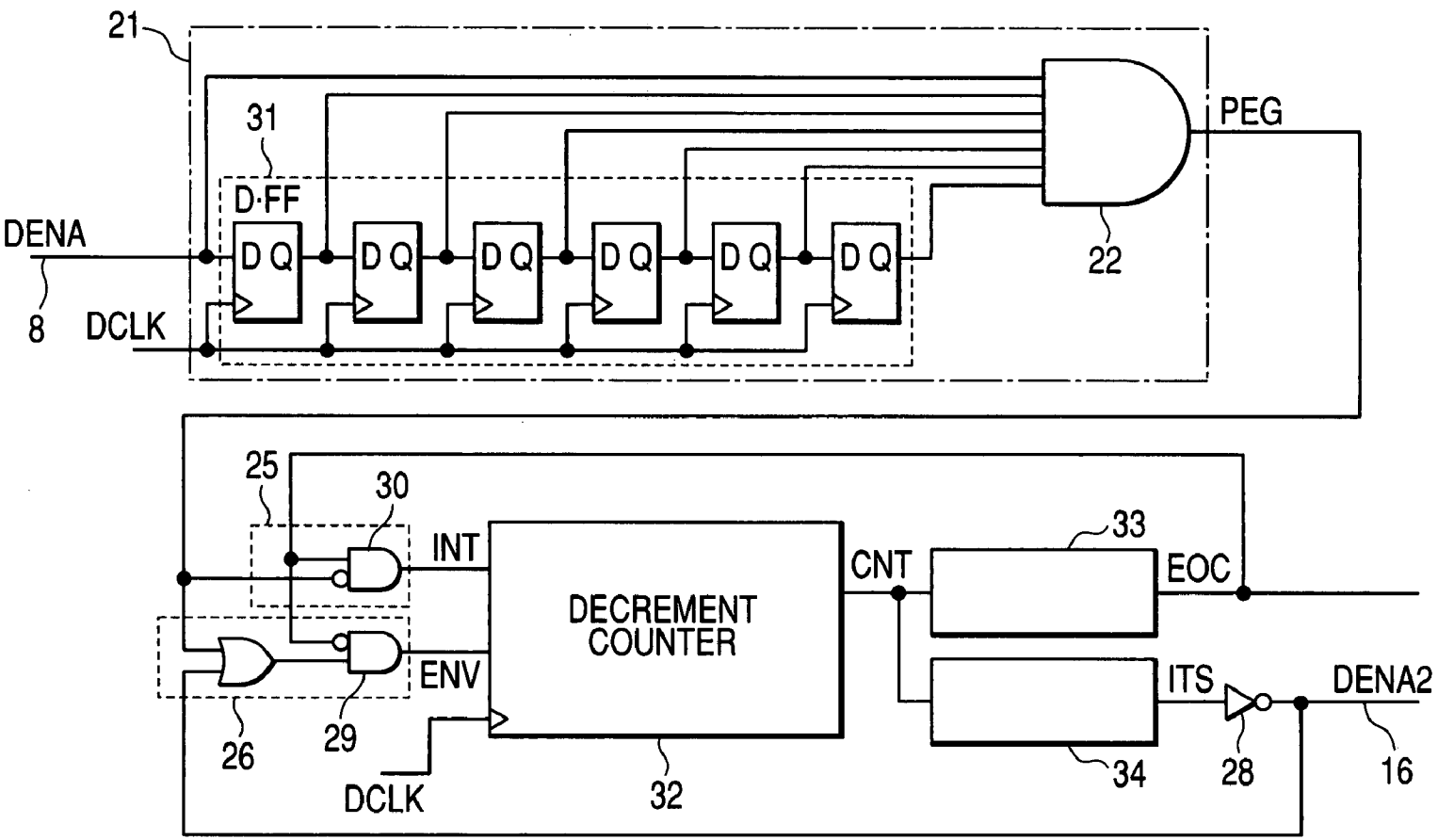
FIG. 7 is a timing diagram of the noise elimination circuit adopting a downcounter according to the first embodiment of the invention.

Further, in FIG. 4 of the first embodiment, the configuration of the noise elimination circuit 6 has been described in which the counter 27 adopts an upcounter that starts a counting operation from an initial value 0 and then increments a count value. However, it is not necessary that the counter 27 adopt the upcounter, but it is possible to adopt a downcounter that presets the specified value on the counter 32 at the time of initialization so as to downcount DCLK input pulses in the same manner as a noise elimination circuit 40 in which a downcounter shown in FIG. 7 is adopted. In this case, a horizontal pixel number detection unit 43 has a zero value detection circuit, and an initial state detection unit 34 has a specified value detection circuit. Accordingly, an output CNT of the counter 32 becomes zero from the specified value, which is an initial value, as a downcount operation progresses, then a count stop signal EOC output from the zero value detection circuit becomes High, then the count stop signal EOC is input to an initialization circuit unit 25 so as to make the initialization signal INT High, and then the initial value 1024 is preset in the counter 32. Construction and operations of circuit units other than described above are the same as those in FIG. 4, and it is possible to obtain the same noise elimination function.

Further, even though the number of D-FFs has been six stages in the delay circuit block 31 of the noise elimination circuit 6, it is not limited thereto but may be set to another number because the filter coefficient is only determined by the stage number of D-FFs having the noise elimination function. However, if the stage number of D-FFs is small, the noise elimination circuit 6 sensitively responds to a noise (High) signal generated during an inactive period (Low period) of an input signal, and as a result, there is a possibility that a rising point will be ahead of an original input signal position. In contrast, if the stage number of D-FFs is large, the noise elimination circuit 6 does not respond to the noise (High) signal generated during an inactive period (Low period) of an input signal and thus desired operations can be expected, but a possibility that the rising point will be behind the original input signal position is increased because the noise elimination circuit 6 becomes sensitive to a noise generated for a rising edge of the original input signal. Since the noise pulse width when the LVDS receiver malfunctions due to discharge of a static noise corresponds to several to tens of several DCLK periods, it is preferable that the number of D-FFs be set in the range of 2 to 30.

Second Embodiment

Figure 8:
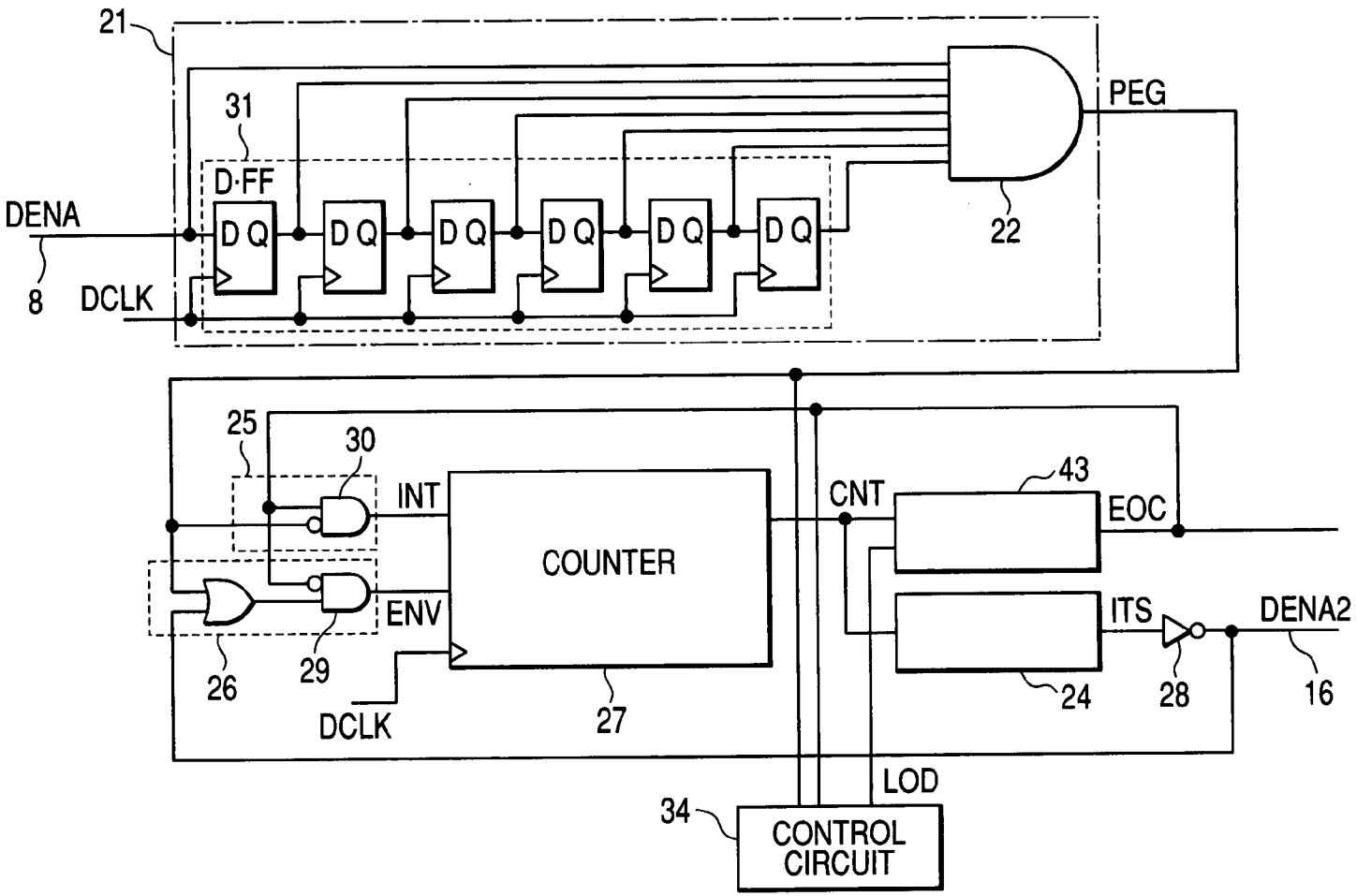
FIG. 8 is a view illustrating the configuration of a noise elimination circuit according to the second and third embodiments of the invention.

In a second embodiment, as shown in FIG. 8, the specified value detection circuit adopted in the first embodiment is configured to be able to correspond to various resolutions of a liquid crystal panel by providing a control circuit 34 provided outside a noise elimination circuit 41, the control circuit 34 being able to supplying a specified output LOD.

Here, components other than the noise elimination circuit 41, such as a system configuration of a liquid crystal display device in the second embodiment, are the same as those adopted in the first embodiment, and thus the same components are denoted by the same reference numerals and detailed explanation thereof will be omitted.

In the noise elimination circuit 41, a horizontal pixel number detection unit 43 has a function detecting whether a signal CNT matches a specified value and is configured such that the specified value output LOD can be set through an external control. Due to the control circuit 34 configured above, the specified value of the noise elimination circuit 41 can be changed corresponding to various resolution specifications of liquid crystal panels, and accordingly, it is possible to correspond to liquid crystal display devices having various resolutions by using one kind of timing controller adopting the noise elimination circuit 41.

Here, a specific method in which the specified value is set to the noise elimination circuit 41 included in a timing controller by using the external control circuit 34 will be exemplified. As one typical method, there is a method in which one or more set terminals are prepared in the control circuit 34 (not shown), and one of a plurality of set values provided beforehand in a logic circuit within the timing controller or the noise elimination circuit 41 is selected on the basis of High/Low of a corresponding terminal so as to make the one set value the specified value of the horizontal pixel number detection unit 43.

Further, a ROM (not shown) recorded with specified data may be provided within the timing controller or outside the timing controller, and the specified value output LOD read out from the ROM through the control circuit 34 may be set in the horizontal pixel number detection unit 43 of the noise elimination circuit 41. In this case, by changing the content of the ROM, it is possible to change the specified value without changing the logic circuit of the timing controller. As a result, it is possible to apply the noise elimination circuit 41 to a liquid crystal panel having a special resolution other than resolution prepared beforehand in a relatively early time.

Furthermore, even though it has been described that the control circuit 34 is provided within the timing controller 6, the position is not limited thereto, but the control circuit 34 may be provided in any other places.

Third Embodiment

In a third embodiment, it is configured that a detection output EOC of the horizontal pixel number detection unit 43 included in the noise elimination circuit 41 adopted in the second embodiment is input to the control circuit 34 as shown in FIG. 8, and the control circuit 34 determines step by step whether a predefined resolution matches a resolution of a liquid crystal panel which is to be displayed on the basis of the length of a signal DENA input for displaying on the liquid crystal panel so as to set the specified value.

Here, components other than the noise elimination circuit 41, such as a system configuration of a liquid crystal display device in the third embodiment, are the same as those adopted in the first and second embodiments, and thus the same components are denoted by the same reference numerals and detailed explanation thereof will be omitted.

Next, a specified value set operation of the control circuit 34 will be described in detail. First, during a horizontal blanking period, the control circuit 34 assumes a little small value (that is, the specified value corresponding to, for example, VGA is 640) and sets the value in the horizontal pixel number detection unit 43 as the specified value LOD. Then, a DENA rising edge detection unit 21 makes a rising edge detection output PEG High, which allows a counter 27 to count, and thus an output CNT increases from zero. Here, when a value obtained by dividing the active period length of an input DENA signal 8 by a DCLK period is 640 and is the same as the specified value LOD, a High pulse is output as the rising edge detection output EOC of the horizontal pixel number detection unit 43 at a time when the CNT output becomes 640. Then, the control circuit 34 reads out the High pulse and is input with the High/Low PEG signal. Since the High pulse of the output EOC means that the specified value LOD and the CNT output value of the counter 27 are equal to each other, that is, 640, the active period length of the DENA is more than 640 DCLK periods. Here, when the PEG signal output to the control circuit 34 is Low, since it means that the input DENA signal 8 is already Low, the horizontal resolution output from the display controller is 640, and thus the specified value set operation of the control circuit 34 is completed.

Since a case, in which the PEG signal when the High pulse appears on the output EOC is High, means that the horizontal resolution exceeds 640, the control circuit 34 outputs 800 (corresponding to SVGA) as the specified value LOD, which becomes a set value of the horizontal pixel number detection unit 43. Subsequently, the DENA signal becomes active, the PEG signal allows the count operation of the upcounter 27, the High pulse is output as the detection output EOC of the horizontal pixel number detection unit 43 at the time when the CNT output becomes 800, and the control circuit 34 reads out he High pulse and is input with the High/Low PEG signal. Here, since a case, in which the PEG signal input to the control circuit 34 is Low, means that the input DENA signal 8 is already is Low, the horizontal resolution output from the display controller is 800, and thus the specified value set operation of the control circuit 34 is completed.

In addition, since a case, in which the PEG signal when the High pulse appears on the output EOC is High, means that the horizontal resolution exceeds 800, the control circuit 34 outputs 1024 (corresponding to XGA) as the specified value LOD, which becomes a set value of the horizontal pixel number detection unit 43.

Thereafter, by repeating the specified value set operation and the detection operation of the PEG signal are repeated until the maximum resolution specified by the control circuit 34 and by incrementing the specified value output LOD step by step, it is possible to read out the High/Low of the PEG signal at the time when the High pulse has been output as the detection output EOD and to determine whether or not the LOD value temporarily set by the control circuit 34 is proper, and thus the control circuit 34 can select a proper set value corresponding to the resolution of the display panel 10.

Furthermore, the set value has been selected by incrementing the predefined resolution step by step so as to reduce a period of time until the selection of the proper set value is completed. However, in a case in which, for example, the resolution of a liquid crystal panel is not normal, a method may be adopted in which the set value is incremented from a predetermined minimum value one by one so as to read out the High/Low of the PEG signal, thereby determining whether or not the set value is proper. In this case, the rising time of the rising edge detection output generated from the input DENA signal is delayed by six DCLK periods, and correspondingly, the count start of a counter is delayed. Therefore, a final set value LOD can be set by adding a value corresponding to the six DCLK periods to the set value which first makes the PEG signal Low as the set value is incremented.

Fourth Embodiment

Figure 9:
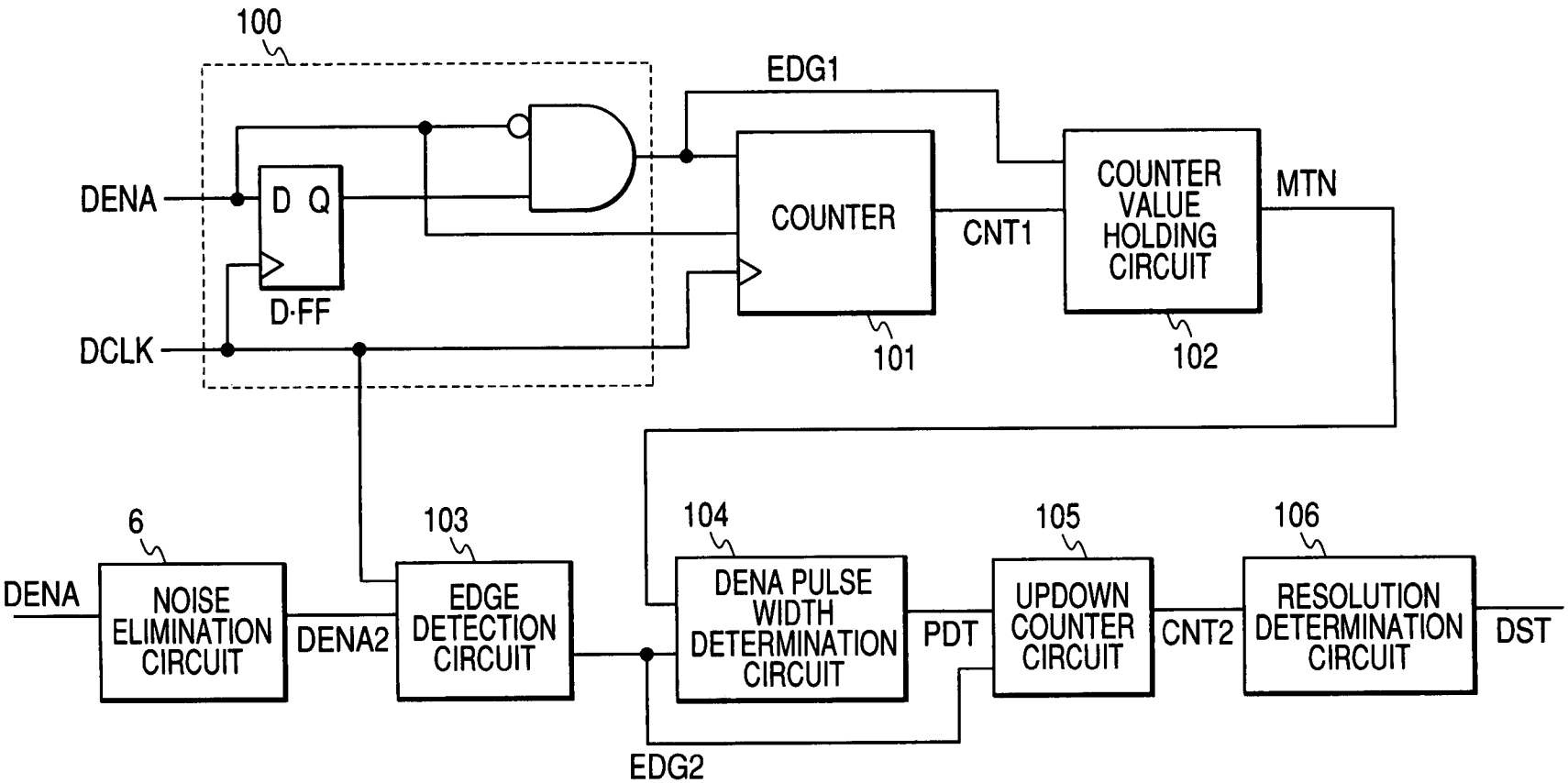
FIG. 9 is a view illustrating the configuration of a resolution judgment circuit according to the fourth embodiment of the invention.

FIG. 9 illustrates the configuration of a resolution judgment circuit 50 judging the resolution of a liquid crystal panel by using the DENA2 signal from which the DENA signal and the noise are removed. First, a first counter 101 is input with a falling edge detection output EDG1 of an edge detection circuit unit 100, DENA, and DCLK, the edge detection circuit unit 100 detecting a falling edge of a DENA signal. The counter 101 starts a count operation on the DCLK when the DENA becomes active (High), and stops the count operation when a falling edge EDG1 is input thereto and then outputs a first counter value CNT1 to a counter value holding circuit unit 102. In addition, the first counter value CNT1 is reset to be zero when the DENA input to the counter 101 becomes inactive (Low), which makes the first counter value CNT1 zero. When the falling edge EDG1 is input to the counter value holding circuit unit 102, the counter value holding circuit unit 102 holds the CNT1 at that time and outputs a count holding value MTN held therein to a DENA pulse width determination circuit 104. An edge detection circuit 103 is composed of the same circuits as the edge detection circuit unit 100 and detects a falling edge of the DENA2 so as to output a corresponding edge EDG2 to the DENA pulse width determination circuit 104. The DENA pulse width determination circuit 104 is input with the EDG2 signal and the MTN signal, and outputs a PDT signal to a second counter, that is, an updown counter 105 in synchronization with a rising edge of the EDG2 signal, the PDT signal indicating whether the MTN value at the time when the EDG2 pulse is input is larger or smaller than a predefined threshold value. The updown counter 105 is a 4-bit counter to which the PDT signal and the EDG2 signal are input and the count value is incremented whenever the rising edge of the EDG2 signal is input thereto. The updown counter 105 increments the count value when the PDT signal is High and decrements the count value when the PDT signal is Low. In addition, the count value CNT2, that is, the second count value of the updown counter 105 is in the range of a minimum value 0 to a maximum value 15, and the carry-over from 0 to 15 and 15 to 0 is not performed. The second count value CNT2 is input to a resolution determination circuit 106, and the resolution is determined by the resolution determination circuit 106 to be output as a determination result DST. The corresponding determination result DST is used as a signal specifying the horizontal resolution of the liquid crystal panel 10 within a digital circuit included in the timing controller, for example, in the timing control circuit 4, shown in FIG. 1.

Figure 10:
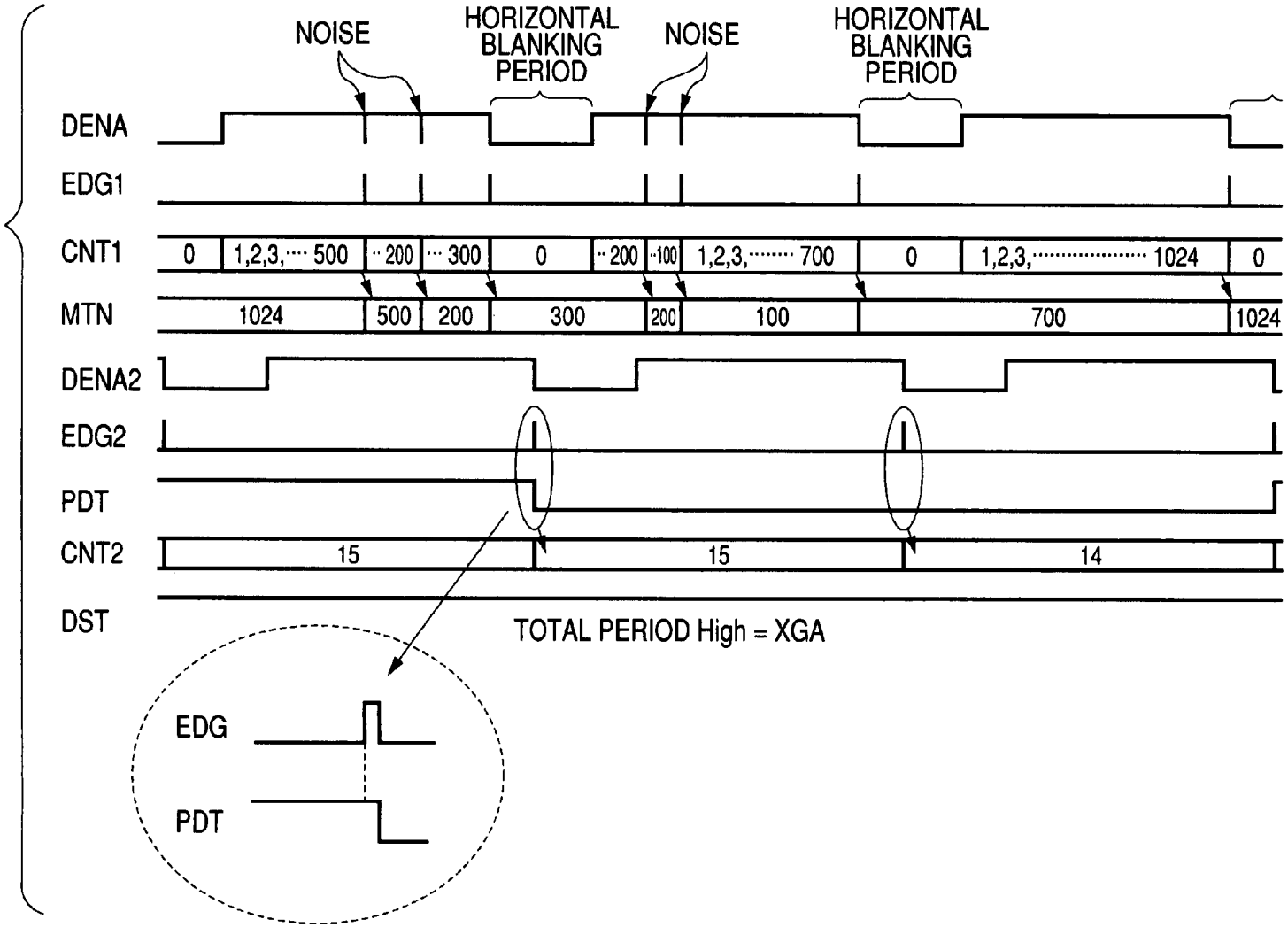
FIG. 10 is a timing diagram of the resolution judgment circuit according to the fourth embodiment of the invention.

Next, the timing principle of the resolution judgment circuit 50 will be described in detail with reference to FIG. 10. In FIG. 10, it is assumed that a noise is superposed on the DENA signal during the active (High) period and thus a small pulse having Low level is included in the DENA signal. As a result, in the edge detection circuit unit 100, a falling edge due to the noise is detected, and an EDG1 output is detected ahead of a regular blanking start time (in the present embodiment, two falling edges are assumed to be detected). As a result, for the MTN output, 500 and 200 are sequentially maintained subsequent to a regular value 1024, and 300 is maintained and output even during a blanking period for which 1024 is to be maintained.

Next, since the DENA2 from which a noise is removed during the blanking period falls, the EDG2 signal is generated, and since the MTN value 300 is smaller than a predetermined value, for example, an intermediate value 912 between horizontal resolutions of SVGA and XGA, a value of the pulse width determination output PDT of the DENA pulse width determination circuit unit 104 becomes Low in synchronization with a falling edge of the EDG2. As described above, the updown counter 105 is a counter inputted in synchronization with the rising edge of the EDG2. In addition, as shown in an enlarged view at a lower part of FIG. 10, since the updown counter 105 is in High at the rising edge of the EDG2, the count value maintains the maximum vale 15.

Even in a horizontal period next to the horizontal period described above, when a noise is superposed on the DENA signal, the same timing result as described above is obtained, so that the detailed description herein will be omitted. In short, since the PDT output becomes Low in the same manner as in the previous period, the updown counter 105 reads out the PDT output Low in synchronization with a rising edge of the EDG2 so as to decrease the count value from 15 to 14. That is, an increment or decrement processing is performed by the updown counter 105 always one horizontal period late.

The count value CNT2 of the updown counter 105 is input to the resolution determination circuit 106 which determines whether the count value CNT2 is larger or smaller than a predetermined value (for example, 7), being output as the determination result DST.

Here, even though a 4-bit counter (count from 0 to 15) has been exemplified as the updown counter 105 in the fourth embodiment, for example, a 3-bit counter (count from 0 to 7) obtained by simplifying a circuit or an 8-bit counter (count from 0 to 255) to achieve even higher noise elimination effect may be selected.

Further, even though the updown counter 105 counts in synchronization with the rising edge of the EDG2 in the fourth embodiment, the updown counter 105 counts in synchronization with the falling edge of the EDG2 if it is possible not to consider a variation timing of the PDT signal.

As described above, the falling edge of the DENA is counted by using the DENA2 signal from which a noise is eliminated and it is determined whether the count value is larger or smaller than a predefined threshold value (912) so as to count it, and thus it is possible to obtain the resolution judgment circuit 50 in which there is no possibility of an erroneous judgment even when a noise is superposed.

Further, in a case of judging that an inputted display control signal corresponds to which resolution of a plurality of horizontal resolutions, an intermediate value of each list to be judged is preferably set to the predetermined threshold value.

Furthermore, in the first to fourth embodiments described above, the D-FF circuit has been exemplified as a delay element adopted in the delay circuit block 31, however, other delay elements may be used. For example, a delay circuit using an inverter circuit, having a plurality of stages, exemplified in JP-A-11-214964 or JP-A-11-251884 may be adopted, or a delay circuit in which an inverter circuit and the D-FF circuit are combined may be adopted.

In addition, even though the above description has been made assuming that the data enable signal (DENA) is at High level while the data enable signal (DENA) is active, the level while the data enable signal (DENA) is active is not necessarily High, but the data enable signal (DENA) may be a Low active signal. In this case, it is apparent that the above description can be applied in the first to fourth embodiments by slightly modifying the configuration of a logic circuit of the DENA rising edge detection unit.

What is claimed is:

1. A noise elimination circuit that eliminates a noise of a display control signal of a matrix display device, comprising:

a rising edge detection circuit unit that detects a rising edge of a signal for eliminating a noise;

a counter that performs a count operation during a predefined period of time;

an initialization circuit unit that generates an initialization signal of the counter;

a count enable circuit unit that generates a count allowance signal of the counter; and an initial state detection circuit unit that detects whether or not the counter is in an initial state, wherein the counter starts the count operation from an initial value in response to a rising edge detection by the rising edge detection circuit unit, the counter is reinitialized after the count operation during the predefined period of time is completed, and an initial state detection signal by the initial state detection circuit unit becomes a signal from which a noise is eliminated.

2. The noise elimination circuit according to claim 1, wherein a count value of the counter is maintained while a data enable signal is in an active state, and the counter is initialized when the data enable signal becomes in an inactive state.

3. A noise elimination circuit that eliminates a noise of a display control signal of a matrix display device, comprising:

a rising edge detection circuit unit that detects a rising edge of a data enable input signal included in the display control signal;

a counter that counts a clock signal included in the display control signal, is initialized by an initialization signal, and performs a count operation in response to a count allowance signal;

a horizontal pixel number detection unit that outputs a count stop signal when an output value of the counter becomes a predefined value;

an initial state detection circuit unit that detects whether or not the counter is in an initial state and outputs an initial state detection signal;

an initialization circuit unit that is input with an output signal of the rising edge detection circuit unit and the count stop signal, and outputs the initialization signal; and a count enable circuit unit that is input with the output signal of the rising edge detection circuit unit, the count stop signal, and the initial state detection signal, and outputs the count allowance signal, wherein the counter starts the count operation in response to the count allowance signal output from the count enable circuit unit by a rising edge detection output of the rising edge detection circuit unit, the count stop signal is output from the horizontal pixel number detection unit after the predefined value is counted, the count allowance signal becomes in an unallowed state and the initialization signal is output from the initialization circuit unit in response to the count stop signal, the counter is initiallized, and the initial state detection signal becomes as a data enable output signal.

4. The noise elimination circuit according to claim 3, wherein the rising edge of the signal for eliminating a noise is detected by the rising edge detection circuit unit that detects the rising edge of the signal for eliminating a noise on a basis of a logical product operation output of a plurality of stages of delay circuits having different delay time.

5. The noise elimination circuit according to claim 4, wherein the delay circuits are two to thirty D flip-flop circuits.

6. The noise elimination circuit according to claim 1, further comprising:

a control circuit unit that is input with a count stop signal of a horizontal pixel number detection unit and a rising edge detection output, wherein an arbitrary horizontal pixel number can be set in the horizontal pixel number detection unit as a specified value by using an output signal of the control circuit, and when the count stop signal is input to the control circuit unit, the control circuit unit increments the horizontal pixel number if the rising edge detection output is in an inactive state.

7. The noise elimination circuit according to claim 3, further comprising:

a control circuit unit that is input with a count stop signal of the horizontal pixel number detection unit and the rising edge detection output, wherein an arbitrary horizontal pixel number can be set in the horizontal pixel number detection unit as a specified value by using an output signal of the control circuit, and when the count stop signal is input to the control circuit unit, the control circuit unit increments the horizontal pixel number if the rising edge detection output is in an inactive state.

8. The noise elimination circuit according to claim 4, wherein a display data signal passes through delay circuits as many as a number corresponding to a delay amount of a signal for eliminating a noise in the rising edge detection circuit unit.

9. A resolution judgment circuit comprising:

a first counter that counts between an edge of a data enable input signal waveform and next edge thereof; and a count value holding circuit unit that holds a first count value of the first counter; and a second counter that determines whether the first count value held in the count value holing circuit is larger or smaller than a predetermined threshold value in synchronization with an output of a noise elimination circuit, and increments a second count value if the first count value is larger than the predetermined threshold value and decrements the second count value if the first count value is smaller than the predetermined threshold value, wherein the noise elimination circuit includes:

a rising edge detection circuit unit that detects a rising edge of a signal for eliminating a noise;

a counter that performs a count operation during a predefined period of time;

an initialization circuit unit that generates an initialization signal of the counter;

a count enable circuit unit that generates a count allowance signal of the counter; and an initial state detection circuit unit that detects whether or not the counter is in an initial state, the counter starts the count operation from an initial value in response to a rising edge detection by the rising edge detection circuit unit, the counter is reinitialized after the count operation during the predefined period of time is completed, and an initial state detection signal by the initial state detection circuit unit becomes a signal from which a noise is eliminated.

10. A matrix display device using a noise elimination circuit, which includes:

a rising edge detection circuit unit that detects a rising edge of a signal for eliminating a noise;

a counter that performs a count operation during a predefined period of time;

an initialization circuit unit that generates an initialization signal of the counter;

a count enable circuit unit that generates a count allowance signal of the counter; and an initial state detection circuit unit that detects whether or not the counter is in an initial state, the counter starts the count operation from an initial value in response to a rising edge detection by the rising edge detection circuit unit, the counter is reinitialized after the count operation during the predefined period of time is completed, and an initial state detection signal by the initial state detection circuit unit becomes a signal from which a noise is eliminated.

* * * * *